United States Patent [19]

Kaspersma et al.

[11] 4,306,918

[45] Dec. 22, 1981

[54] PROCESS FOR CARBURIZING FERROUS METALS

[75] Inventors: Jelle H. Kaspersma; Robert J. Peartree, both of Coopersburg, Pa.

[73] Assignee: Air Products and Chemicals, Inc., Allentown, Pa.

[21] Appl. No.: 142,800

[22] Filed: Apr. 22, 1980

[51] Int. Cl.[3] ..... C21D 1/48

[52] U.S. Cl. ..... 148/16.5; 148/16.6; 148/20.3

[58] Field of Search ..... 148/16, 16.5, 16.6, 148/20.3

[56] References Cited

U.S. PATENT DOCUMENTS

| | | | |
|---|---|---|---|
| 2,673,821 | 3/1954 | Stutzman | 148/16.5 |
| 3,201,290 | 8/1965 | Wyss | 148/16 |
| 4,049,472 | 9/1977 | Arndt | 148/16 |
| 4,145,232 | 3/1979 | Solomon | 148/16.5 |
| 4,154,629 | 5/1979 | Asai et al. | 148/16.5 |

*Primary Examiner*—L. Dewayne Rutledge

*Assistant Examiner*—John P. Sheehan

*Attorney, Agent, or Firm*—James C. Simmons; E. Eugene Innis

[57] ABSTRACT

A process for carburizing steel in a furnace under an atmosphere derived from the decomposition of an oxygenated hydrocarbon containing up to three carbon atoms, no more than one carbon to carbon bond, and a carbon to oxygen ratio of from 1 to 2 such as alcohols, aldehydes, ethers, esters and mixtures thereof. The oxygenated hydrocarbon injected into the furnace produces an atmosphere under which an initial rapid stage of carburization takes place. After the initial rapid stage of carburization gaseous nitrogen is blended into the oxygenated hydrocarbon atmosphere throughout the remainder of the process with a concurrent reduction in the rate of injection of oxygenated hydrocarbon while maintaining volumetric flow through the furnace during the entire carburizing cycle. During the entire carburizing cycle, the carbon potential of the furnace atmosphere can be controlled by addition of a hydrocarbon gas enriching or carburizing agent.

22 Claims, No Drawings

PROCESS FOR CARBURIZING FERROUS METALS

TECHNICAL FIELD

This invention relates to a process for gas carburization of ferrous metals and in particular to a process wherein a furnace atmosphere is created by injecting an oxygenated hydrocarbon into said furnace during the period of rapid carburization followed by control of the atmosphere during the later stages of carburization by reducing the rate of injection of oxygenated hydrocarbon while maintaining volumetric flow through the furnace by injecting a nonreactive gas along with said oxygenated hydrocarbon. Carbon potential of the furnace atmosphere is maintained during the carburizing cycle by the addition of controlled amounts of enriching or hydrocarbon carburizing agents to the mixture.

BACKGROUND OF PRIOR ART

Carburization is the conventional process for case hardening of steel. In gas carburizing the steel is exposed to an atmosphere which contains components capable of transferring carbon to the surface of the metal from which it diffuses into the body of the part. A variety of atmospheres have been employed but the most commonly used one is the so-called endothermic (endo) atmosphere derived by partial combustion of natural gas in air. It is usually necessary to add a relatively small quantity of another constituent, usually natural gas, to the atmosphere to raise the carbon potential.

A thorough discussion of the Prior Art can be found in the section entitled "Furnace Atmospheres and Carbon Control" found at pages 67 through 92, and that portion of the section entitled "Case Hardening of Steel" appearing at pages 93 through 128 of Volume 2 of the Metals Handbook published in 1964 by the American Society for Metals, Metals Park, Ohio. This particular volume of the Metals Handbook is entitled "Heat Treating Cleaning and Finishing." At pages 90 through 91 of the Metals Handbook, Volume 2, there is a discussion of determination of carbon potential of a furnace atmosphere pertinent to the invention set forth below.

U.S. Pat. No. 4,049,472 also summarizes the prior art, the specification of which is herein incorporated by reference. The steel objects to be carburized are exposed at an elevated temperature, usually in the range of about 1600° F. (871° C.), until carbon penetration to a desired depth has been achieved. The metal can then be cooled to room temperature by various known methods such as furnace, air, and media quench to develop the desired physical properties and case hardness in the finished article. The basic endothermic atmosphere produced by the incomplete combustion of natural gas in air consists of approximately 40% $N_2$, 40% $H_2$, and 20% CO. The reaction by which carbon is generally believed to be deposited on the surface of the steel is represented by the following equation (1).

$$H_2+CO=C+H_2O \quad (1)$$

The water produced in equation (1) immediately reacts partially with more CO according to the well-known water gas shift reaction (2).

$$H_2O+CO=CO_2+H_2 \quad (2)$$

Equations (1) and (2) may be added together to yield reaction (3).

$$2CO=C+CO_2 \quad (3)$$

Thus, the net result of carburization by the endothermic atmosphere is the decomposition of nascent carbon on the surface of the metal and concurrent formation of an equivalent amount of $CO_2$ or $H_2O$. These two substances, $CO_2$ and $H_2O$, cause the reversal of reactions (1) and (3), and if allowed to accumulate would quickly bring the carburization process to a halt. The purpose of the added hydrocarbon mentioned above is to remove the $H_2O$ and $CO_2$ and regenerate more active reactive gases according to reactions (4a) and (4b).

$$CO_2+CH_4=2CO+H_2 \quad (4a)$$

$$H_2O+CH_4=3H_2+CO \quad (4b)$$

Another method of generating a carburizing atmosphere which has been developed relatively recently, involves decomposition of methanol, either alone or in combination with nitrogen, according to equation (5).

$$CH_3OH=2H_2+CO \quad (5)$$

It will be noted that the ratio of $H_2$ to CO is 2 to 1, the same as that produced in the endothermic atmosphere by partial combustion of natural gas. By choice of appropriate quantities of nitrogen and methanol it is possible to generate a synthetic atmosphere which is essentially identical in composition to that produced by the partial combustion of natural gas. The advantages of using such a synthetic atmosphere are several fold. First, the need for an expensive and elaborate endo gas system is eliminated. The endo gas generator requires continuing maintenance and attention of an operator and furthermore it cannot be turned on and off at will. Once it is running it is necessary to keep it in operation even though the demand for the endothermic atmosphere may vary from maximum load to zero, thus the endo gas, and the natural gas required to produce it are wasted during periods of low demand. The use of nitrogen and methanol on the other hand requires only those storage facilities adequate for liquid or gaseous nitrogen and liquid methanol until they are needed. Furthermore, the nitrogen and methanol can both be injected as such directly into the furnace without the need for a separate gas generator. The methanol is immediately cracked by the high temperatures encountered in the furnace. A further advantage of the methanol-nitrogen system is that the methanol is uniform in composition while natural gas contains, in addition to methane, widely varying amounts of ethane, propane and other higher hydrocarbons which affect the stoichiometry of the partial combustion reaction and may give rise to atmospheres of substantially varying composition which in turn leads to erratic and poorly controlled behavior of the carburization process itself.

It has been shown by others, for example in U.S. Pat. No. 4,145,232, that methanol and nitrogen may be used to provide a carrier gas having essentially the same composition as endothermic gas. Others have shown, for example U.S. Pat. No. 3,201,290, that pure methanol may be used to provide a carrier gas comprised essentially of only CO and $H_2$. A number of advantages are claimed for the latter atmosphere. First the carbon availability (the quality of carbon available for reaction per unit volume of atmosphere) is greater by a factor of 67% in the pure methanol-derived atmosphere than it is in the endothermic gas composition. This greater availability results in more uniform carburization of the workpiece since there is less likelihood of the atmosphere being depleted of carbon in regions where gas circulation is poor, for example in blind spots where several workpieces may obstruct the free flow of atmosphere in the furnace. A further advantage of the pure methanol-based atmosphere is that the kinetics of the carbon transfer are greatly enhanced. The rate at which carbon can be transferred is given by the following equation:

$$R = k \times P_{CO} \times P_{H2}$$

The rate of carbon transfer from a gas consisting of two-thirds $H_2$, and one-third CO, is almost 2.8 times that of the endothermic atmosphere which contains only 40% $H_2$ and 20% CO. Thus, it is possible to achieve more rapid carburization and lowered cycle time by the use of the pure methanol carrier gas.

However, a pure methanol-based atmosphere is inherently more expensive both in terms of monetary value and the energy required to produce it, than is an atmosphere derived in part from methanol. For example, total energy requirement to produce 100 SCF of base gas nitrogen at 1700° F. (927° C.) is 37,200 BTU's, while to produce the same volume of a base gas consisting of two-thirds $H_2$ and one-third CO by decomposition of methanol 61,800 BTU's are required. These requirements include the energy necessary to heat the gas from ambient temperature to 1700° F. (927° C.), and in the case of nitrogen, the energy required to separate nitrogen from the air while in the case of methanol, the energy equivalent of the raw material to produce the methanol and the energy required in its synthesis and decomposition. The energy required to produce 100 SCF equivalent of synthetic endo gas from methanol and nitrogen is 51,900 BTU.

Thus it is evident that although the atmosphere derived from pure methanol is advantageous in insuring that carburization proceeds uniformly and at a rapid rate, it is more expensive and consumes more energy than does an atmosphere derived from a combination of methanol and nitrogen. The more rapid carburization achieved with the pure methanol atmosphere is desirable since it results in a shorter cycle time to achieve a given case depth, and thereby lowers the amount of energy lost through the furnace walls. However, this gain in energy conservation is to some extent offset by the higher thermal conductivity of the pure methanol-derived atmosphere as compared to the synthetic endo atmosphere because of the greater hydrogen content of the former. It is estimated that this increased hydrogen concentration results in a heat loss rate ranging from about 9% to about 14% greater for the all-methanol derived atmosphere.

BRIEF SUMMARY OF THE INVENTION

It has been found that the use of an oxygenated hydrocarbon containing carbon, hydrogen and oxygen having from 1 to 3 carbon atoms, no more than one carbon to carbon bond and a carbon to oxygen ratio of from 1 to 2 selected from the group consisting of alcohols, aldehydes, ethers, esters and mixtures thereof, and in particular the pure methanol-derived atmosphere during the first part of a carburization cycle provides the advantage of initially high carburization rate which is manifested in a reduced total cycle time. But it has also been found that after a period of time, part of the expensive methanol may be replaced by less expensive nitrogen without an accompanying increase in the time necessary to achieve a given case depth.

Thus, the advantage of both types of atmospheres may be combined in a single process with a resultant lowering of the overall energy requirement. Carbon potential of the atmosphere is maintained during carburization by addition of controlled amount of enriching or hydrocarbon agents (e.g. methane) to the furnace.

DETAILED DESCRIPTION OF THE INVENTION

In the conventional endo process, a carrier gas mixture is obtained by catalytic partial oxidation of hydrocarbons (e.g. natural gas) resulting in a mixture which consists mainly of 20% CO, 40% $H_2$ and 40% $N_2$. Hydrocarbons (e.g. excess natural gas) are usually added to provide the carbon required. The carbon potential, which determines the degree of carburization, is controlled by monitoring either the $CO_2$ or the $H_2O$ concentration in the furnace gas. Theoretically, the proper control parameters are $Pco^2/Pco_2$ and $PcoPH_2/PH_2o$, but since Pco and $PH_2$ are kept virtually constant, one component control by $Pco_2$ or $PH_2O$ is possible.

Instead of generating the carrier gas catalytically, it may also be generated by thermal cracking of mixtures of nitrogen and oxygenated hydrocarbons (e.g. methanol). All carbon-hydrogen-oxygen compounds containing up to 3 carbon atoms, but with no more than one carbon to carbon bond, and having a carbon to oxygen ratio of from 1 to 2 and a boiling point not greater than 100° C. including alcohols, aldehydes, ethers, and esters are candidates for the atmosphere. Methanol is the preferred oxygenated hydrocarbon for this process however ethanol, acetaldehyde dimethylether, methyl formate and methylacetate have been shown to produce high CO and $H_2$ levels. So far efforts have been directed to imitating the composition of the endo gas mixture only, in order to achieve comparable results at temperature. This makes it possible to use exactly the same carbon control mechanism as used with the endo system, (i.e. conventional one component carbon control).

The present invention is directed toward improving the results obtained by the endothermic process, but at the same time at maintaining its simple carbon control mechanism. Better results are obtained by increasing the carbon transfer rate. That is achieved by higher CO and $H_2$ concentrations which enhance the rate of the main carbon transfer reaction:

$$CO + H_2 = H_2O + C$$

Since most of the carbon is needed during the first part of the carburizing cycle when the rate of diffusion is very high due to a very steep carbon gradient, improvement can only be achieved during this period. In the later part of the cycle, the diffusion rate becomes so slow that improving the carbon transfer rate by higher CO and $H_2$ concentrations does not make any difference. Therefore, the present invention resides in maintaining CO and $H_2$ concentrations higher than endo composition in the first part of the cycle in order to speed up carbon transfer and to reduce CO and $H_2$ concentrations in the later part of the cycle to endo composition which will enable the use of conventional one component control.

Higher CO and $H_2$ levels may be obtained by reducing the nitrogen content in a nitrogen-oxygenated hydrocarbon mixture to be thermally cracked.

For the tests summarized in Table I below, a closed batch heat treating furnace having a volume of 8 cu. ft. (0.227 cu. m) was used. The furnace was equipped with a circulating fan and thermostatically controlled electric heater. Provision was made for introduction of nitrogen gas and methanol liquid, the latter as a spray. The furnace was vented through a small pipe leading to a flare stack. There was also provision for admitting enriching gas (e.g. natural gas) to the furnace.

The exit line was fitted with a sampling device and analytical means which permitted measurement of the concentration of carbon monoxide and carbon dioxide in the exit stream. The carbon potential of the exit gas was calculated according to well-known chemical equilibrium equations and the amount of the enriching gas admitted to the furnace was varied so as to maintain a desired carbon potential (CP) in the furnace. An increase in enriching gas (e.g. natural gas) flow resulted in an increase in carbon potential while a decrease in enriching gas resulted in an corresponding decrease in carbon potential.

In each of the tests the furnace was loaded with approximately 15 lb. of 1010 steel rivets, purged with nitrogen, and brought up to a final temperature of 1700° F. (927° C.). Nitrogen and/or methanol was passed into the furnace at a combined rate corresponding to about 3–5 standard volume changes per hour of the furnace atmosphere.

Three different basic atmospheres were used separately or in combination in the various tests. The first of these, called the 100% atmosphere, was generated by the introduction of methanol alone to the furnace, and the furnace atmosphere consisted of a mixture of approximately $\frac{2}{3}$ hydrogen and $\frac{1}{3}$ carbon monoxide. The second atmosphere, known as the Endo atmosphere, was derived from a combination of two parts nitrogen and one part methanol vapor by volume, and had a final composition of approximately 40% nitrogen, 40% hydrogen and 20% carbon monoxide. The third atmosphere, known as the 10% atmosphere, was generated by passing a mixture consisting of approximately 10% methanol and 90% nitrogen into the furnace. Its composition was approximately 75% nitrogen, 16.7% hydrogen and 8.3% carbon monoxide.

In the several tests, natural gas was introduced at different times and concentrations, but the final segment of each test always involved control of the natural gas introduction so as to maintain a targeted carbon potential in the furnace.

Each test involved a total time cycle of three hours including a heat recovery period after loading of thirty minutes. At the end of this time, the rivets were discharged from the furnace, quenched and subjected to metallurgical testing to determine the case depth and hardness. The effectiveness of carbon potential control was determined by the analysis of a shimstock sample which had been placed in the furnace along with the rivets.

In examples I-1 through I-5 natural gas was introduced at an initial rate corresponding to approximately 10% of that of the total gas flow, and was adjusted so as to give a target carbon potential of 1.0% when the furnace load had come to the final temperature of 1700° F. (927° C.). In the first three runs, the 100%, Endo, and 10% atmospheres were employed throughout the entire cycle. The decline in capability of effecting carbon transfer as the nitrogen content of the atmosphere is increased is evident from the case depth data. The Endo atmosphere is only about 87% as effective overall as is the 100% atmosphere, while the 10% atmosphere is only 64% as effective as the 100% atmosphere.

In tests, I-4 and I-5 the 100% atmosphere was employed for the first one hour of operation but then was replaced by Endo and 10% atmospheres, respectively. In test I-4, a combination of 100% and Endo atmospheres was almost as effective (96%) as the 100% atmosphere alone. In test I-5, the combination of 100% and 10% atmospheres was almost as effective (84%) as the Endo atmosphere alone.

Tests I-6 and I-7 indicate that under the conditions of these tests (10% natural gas during warmup) little is accomplished after the first 1.5 hours of operation with the 100% atmosphere. However, this is not the most energy efficient mode of operation.

TABLE I

| | | % C | | Case Depth (inches) | |
|---|---|---|---|---|---|
| Test No. | Base Atmosphere | Target | Shim | Effective | Total |
| I-1 | 100% 3 hr. | 1 | 0.99 | 0.0194 | 0.0405 |
| I-2 | Endo 3 hr. | 1 | 1.01 | 0.0169 | 0.0368 |
| I-3 | 10% 3 hr. | 1 | 0.93 | 0.0125 | 0.0330 |
| I-4 | 100% 1 hr.<br>Endo 2 hr. | 1 | 0.97 | 0.0186 | 0.0370 |
| I-5 | 100% 1 hr.<br>10% 2 hr. | 1 | 0.95 | 0.0163 | 0.0366 |
| I-6 | 100% 1.5 hr.<br>Endo 1.5 hr. | 1.1 | 1.11 | 0.0197 | 0.0406 |
| I-7 | 100% 1.5 hr.<br>10% 1.5 hr. | 1.1 | 1.09 | 0.0205 | 0.0385 |

Table II shows a pair of tests in which natural gas was introduced at a rate of 10% of the total flow for the first 1.5 hours of operation and then was adjusted to yield a carbon potential of 1.1%. In test II-1, the 100% base atmosphere was employed throughout the test while in test II-2 the Endo atmosphere was employed throughout the test. Again the Endo atmosphere is somewhat less effective (93%) than the 100% atmosphere. The final case depth in both tests is somewhat greater than in the first series of tests. This is probably due both to the longer time during which a high level of natural gas flow was maintained and the slightly higher target carbon potential employed.

TABLE II

| | | % C | | Case Depth (inches) | |
|---|---|---|---|---|---|
| Test No. | Base Atmosphere | Target | Shim | Effective | Total |
| II-1 | 100% 3 hr. | 1.1 | 1.12 | 0.0209 | 0.0380 |
| II-2 | Endo 3 hr. | 1.1 | 1.14 | 0.0194 | 0.0370 |

Table III presents a series of tests in which an essentially 100% methanol atmosphere was maintained until the furnace temperature had reached 1600° F. (871° C.). At this time, natural gas was admitted at a rate such that a carbon potential of 1.1 was maintained.

TABLE III

| Test | Base | % C | | Case Depth (inches) | |
|---|---|---|---|---|---|
| No. | Atmosphere | Target | Shim | Effective | Total |
| III-1 | 100% MeOH 3 hr. | 1.1 | 1.14 | 0.0220 | 0.0384 |
| III-2 | Endo 3 hr. | 1.1 | 1.13 | 0.0178 | 0.0351 |
| III-3 | 100% MeOH 1 hr.<br>Endo 2 hr. | 1.1 | 1.12 | 0.0204 | 0.0386 |

TABLE III-continued

| Test No. | Base Atmosphere | % C Target | % C Shim | Case Depth (inches) Effective | Case Depth (inches) Total |
|---|---|---|---|---|---|
| III-4 | 100% MeOH 1.5 hr. Endo 1.5 hr. | 1.1 | 1.12 | 0.0224 | 0.0395 |

Tests III-3 and III-4 indicate that the degree of carburization which can be achieved with a combination of 100% and Endo atmospheres is virtually equal to that which is achieved with the 100% atmosphere alone.

The results obtained in the tests shown in Table III are in all cases superior to the corresponding results shown in Tables I and II where methane was introduced at a high level at the initial part of the cycle. It is believed that in the Table I and II tests, soot deposition which inhibited carburization took place. In the Table III series of tests the surface remained clean because carbon potentials capable of depositing soot were never reached. No advantage is realized by introducing natural gas until the work has approached the final carburizing temperature. Introduction of natural gas prior to this time results not only in wastage but also in sooting which inhibits further carburization.

The degree to which the methanol is diluted by nitrogen may also be varied. In tests III-1 thru III-4 (Table III) dilution to about endo gas composition was found desirable. In Tests I-4 and I-5 Table I dilution to below endo gas composition was found desirable. In Tests I-4 and I-5 (Table I) dilution to below endo composition after only one hour of exposure to the 100% atmosphere lead to lower case depth, but in tests I-6 and I-7 (Table I) the 10% atmosphere was as effective as the endo atmosphere after 1.5 hours exposure to the 100% atmosphere.

The exact time and degree of dilution depends upon the carbon level desired at the surface of the workpiece, the case depth, and temperature at which carburization is carried out. In general, greater case depths and the correspondingly longer times involved, permit greater dilution of the atmosphere. With longer times and greater case depths, the rate of diffusion of carbon from the surface declines and an atmosphere capable of effecting rapid carbon transfer is not needed.

For practical purposes, dilution to less than about 10% $H_2$ and 5% CO is undesirable since it is necessary to provide enough reactive gas to ensure scavenging of the small amount of oxygen which may leak into a conventional heat treating furnace. However, in all cases the use of an atmosphere based entirely on methanol at the beginning of the cycle, followed by dilution with nitrogen during later stages will be found advantageous in reducing the length of the cycle while simultaneously conserving energy. A further refinement of the process involves step-wise increasing dilution of the atmosphere as the cycle progresses so that the rate of carbon transfer to the surface is matched with the rate of carbon diffusion away from the surface.

The method according to the invention includes reducing the rate of injection of oxygenated hydrocarbon by injecting a ratio of from 2 to 1 to 10 to 1 nitrogen to oxygenated hydrocarbon to a total volume flow equal to the volume flow of oxygenated hydrocarbon injected initially into the furance. Two specific ratios found to be effective for nitrogen to oxygenated hydrocarbon are 2 to 1 and 9 to 1.

Specifically, the process of the present invention encompases using methanol as the oxygenated hydrocarbon. After the methanol is injected into the furnace to form the carburizing atmosphere, a hydrocarbon gas is injected into the furnace to establish and maintain the carbon potential of the furnace atmosphere. Subsequent to the initial rapid carburization portion of the total carburizing cycle, the rate of methanol injection can be reduced, the total methanol flow being replaced by nitrogen to thus maintain the total volumetric flow through the furnace as well as the carbon potential of the furnace.

It is also within the scope of the present invention to condition the furnace prior to start-up of a carburizing run by charging into the furnace the liquid equivalent of from three to five volume changes per hour of oxygenated hydrocarbon to condition the furnace atmosphere.

Although the examples of the present inventions were taken from tests where the oxygenated hydrocarbon was sprayed into the furnace in liquid form it can also be vaporized and injected into the furnace separately or with the nitrogen.

According to the present invention gaseous ammonia can be added to the atmosphere to achieve carbonitriding of ferrous metal parts.

STATEMENT OF INDUSTRIAL APPLICATION

Processes according to the present invention can be used in place of existing gas carburizing processes in batch type furnaces and with proper furnace control in continuous furnaces. Existing furnaces can be readily adapted to the present invention without altering systems used to measure carbon potential and with only minor furnace additions to accommodate the hydrocarbon and gas sources.

Having thus described our invention, what is desired to be secured by Letters Patent of the United States, is set out in the appended claims.

We claim:

1. A method of carburizing a ferrous article comprising the steps of:

a. charging the articles to be treated into a furnace maintained at a temperature in excess of 1500° F. (816° C.);

b. injecting into the furnace an oxygenated hydrocarbon containing up to three carbon atoms, no more than one carbon to carbon bond, a carbon to oxygen ratio of from 1 to 2 and a boiling point no greater than 100° C., said oxygenated hydrocarbon selected from the group consisting of alcohols, aldehydes, esters, ethers and mixtures thereof to react and form a carburizing atmosphere in said furnace;

c. establishing and maintaining a rate of injection of said oxygenated hydrocarbon and adding a hydrocarbon gas to maintain a carbon potential of between 0.8 and 1.1% in said furnace atmosphere for at least that portion of the total carburizing process where rapid carburizing occurs;

d. subsequently reducing the rate of oxygenated hydrocarbon injection while maintaining a total injection rate by injecting nitrogen into said furnace to maintain said furnace atmosphere at a carbon potential similar to that for a conventional carburizing atmosphere and for a period of time to complete carburization of said articles to the desired case depth; and e. discharging said articles from said furnace and cooling at a rate determined by the desired physical properties of said article.

2. A method according to claim 1 wherein said furnace is maintained at a temperature of between 1550° F. (816° C.) and 1900° F. (1038° C.).

3. A method according to claim 1 wherein said oxygenated hydrocarbon is selected from the group consisting of methanol, ethanol, acetaldehyde, dimethylether, methyl formate, methlacetate and mixtures thereof.

4. A method according to claim 1 wherein said oxygenated hydrocarbon is methanol.

5. A method according to claim 1 wherein said oxygenated hydrocarbon is ethanol.

6. A method according to claim 1 wherein said oxygenated hydrocarbon is acetaldehyde.

7. A method according to claim 1 wherein said oxygenated hydrocarbon is dimethylether.

8. A method according to claim 1 wherein said oxygenated hydrocarbon is methyl formate.

9. A method according to claim 1 wherein said oxygenated hydrocarbon is methylacetate.

10. A method according to claim 1 wherein prior to charging said furnace the liquid equivalent of from three to five volume changes per hour of oxygenated hydrocarbon is sprayed into said furnace to condition said furnace atmosphere resulting from previous carburizing runs.

11. A method according to claim 1 wherein said reduced rate of injection of oxygenated hydrocarbon is accomplished by injecting a ratio of from 2 to 1 to 10 to 1 nitrogen to oxygenated hydrocarbon to a total volume flow equal to the volume of oxygenated hydrocarbon injected in said preceding step.

12. A method according to claim 11 wherein said ratio of nitrogen to oxygenated hydrocarbon is 2 to 1.

13. A method of carburizing a ferrous article comprising the steps of:

a. charging the articles to be treated into a furnace maintained at a temperature of between 1500° F. (816° C.) and 1900° F. (1043° C.);

b. injecting into the furnace an oxygenated hydrocarbon having from 1 to 3 carbon atoms, no more than one carbon to carbon bond and selected from the group consisting essentially of methanol, ethanol, acetaldehyde, dimethylether, methyl formate, methylacetate and mixtures thereof to react and form a carburizing atmosphere in said furnace;

c. establishing and maintaining a rate of injection of said oxygenated hydrocarbon and adding thereto a hydrocarbon gas to maintain a carbon potential of between 0.8 and 1.1% in said furnace atmosphere for at least that portion of the total carburizing process where rapid carburizing occurs;

d. subsequently reducing the rate of oxygenated hydrocarbon injection while maintaining a total injection rate by injecting nitrogen into said furnace to maintain said furnace atmosphere at a carbon potential in said furnace similar to that for a conventional carburizing atmosphere and for a period of time to complete carburization of said articles to the desired case depth; and e. discharging said articles from said furnace and cooling at a rate determined by the desired physical properties.

14. A method according to claim 13 wherein said oxygenated hydrocarbon is methanol.

15. A method according to claim 13 wherein prior to charging said furnace the liquid equivalent of from three to five volume changes per hour of oxygenated hydrocarbon is sprayed into said furnace to condition said furnace atmosphere resulting from previous carburizing runs.

16. A method according to claim 13 wherein said rapid carburization is effected by injection of said oxygenated hydrocarbons to maintain a furnace atmosphere of about two-thirds hydrogen and one-third carbon monoxide by volume.

17. A method according to claim 13 wherein said reduced rate of injection of oxygenated hydrocarbon is accomplished by injecting a ratio of from 2 to 1 to 10 to 1 nitrogen to oxygenated hydrocarbon to a total volume flow equal to the volume of oxygenated hydrocarbon injected in said preceding step.

18. A method according to claim 17 wherein said ratio of nitrogen to oxygenated hydrocarbon is 2 to 1.

19. A method according to claim 17 wherein said ratio of nitrogen to oxygenated hydrocarbon is 9 to 1.

20. A method of carburizing a ferrous article comprising the steps of:

a. charging the articles to be treated into a furnace maintained at a temperature in excess of 1500° F. (816° C.);

b. injecting methanol into the furnace to react and form a carburizing atmosphere in said furnace;

c. establishing and maintaining a rate of injection of a hydrocarbon gas to maintain a carbon potential of between 0.8 and 1.1% in said furnace atmosphere for at least that portion of the total carburizing process where rapid carburizing occurs;

d. subsequently reducing the rate of methanol injection while maintaining a total injection rate by injecting nitrogen into said furnace to maintain said furnace atmosphere at a carbon potential in said furnace similar to that for a conventional carburizing atmosphere and for a period of time to complete carburization of said articles to the desired case depth; and e. discharging said articles from said furnace and cooling at a rate determined by the desired physical properties of said article.

21. A method according to claim 20 wherein said furnace is maintained at a temperature of between 1550° F. (816° C.) and 1900° F. (1043° C.).

22. A method according to claim 20 where gaseous ammonia is also added to the furnace in order to carbonitride the parts.

* * * * *